US006536867B1

(12) United States Patent
James, III et al.

(10) Patent No.: US 6,536,867 B1
(45) Date of Patent: Mar. 25, 2003

(54) APPARATUS FOR INCREASING WASTE INK ACCUMULATION CAPACITY IN AN INK JET

(75) Inventors: Edmund Hulin James, III, Lexington, KY (US); Christopher Patrick Murphy, Lexington, KY (US); Terry Lee King, Versailles, KY (US); Nolan Francis Luckett, Versailles, KY (US)

(73) Assignee: Lexmark International, Inc., Lexington, KY (US)

( * ) Notice: Subject to any disclaimer, the term of this patent is extended or adjusted under 35 U.S.C. 154(b) by 35 days.

(21) Appl. No.: 09/378,802

(22) Filed: Aug. 23, 1999

(51) Int. Cl.[7] ..... B41J 2/165
(52) U.S. Cl. ..... 347/36; 347/32
(58) Field of Search ..... 347/36, 32–33, 347/22

(56) References Cited

U.S. PATENT DOCUMENTS

| | | | | |
|---|---|---|---|---|
| 5,357,275 A | | 10/1994 | Ikado et al. | |
| 5,517,221 A | | 5/1996 | Nguyen | |
| 5,617,125 A | | 4/1997 | Chew | |
| 5,670,996 A | | 9/1997 | Mitani | |
| 5,719,603 A | | 2/1998 | Nguyen | |
| 5,831,647 A | * | 11/1998 | Kawakami et al. | 347/36 |
| 5,896,145 A | * | 4/1999 | Osborne et al. | 347/33 |
| 5,980,018 A | * | 11/1999 | Taylor et al. | 347/31 |

* cited by examiner

*Primary Examiner*—Shih-wen Hsieh
(74) *Attorney, Agent, or Firm*—Elizabeth C. Jacobs

(57) ABSTRACT

A maintenance unit for use in an ink jet printer includes a maintenance frame coupled to a printer frame, a maintenance sled moveably coupled to the maintenance frame and a spreader mechanism coupled to the maintenance sled, wherein the spreader mechanism disperses waste ink over a waste ink accumulation region as the maintenance sled moves relative to the maintenance frame.

14 Claims, 4 Drawing Sheets

APPARATUS FOR INCREASING WASTE INK ACCUMULATION CAPACITY IN AN INK JET

TECHNICAL FIELD OF INVENTION

The present invention is directed generally to the handling of waste ink accumulated in an ink jet printer system, and more particularly, to an apparatus and method for increasing the effective capacity for storing waste ink in a maintenance station without increasing the physical capacity of the waste ink collection reservoir.

BACKGROUND OF THE INVENTION

Ink jet printers require maintenance operations to keep the nozzles of the print cartridge operating properly. Such maintenance operations typically include a combination of wiping the nozzle area of the print cartridge, firing the nozzles at prescribed intervals (spitting), and capping the cartridge during idle periods to prevent the jetted ink which remains on the nozzle plate from drying and clogging one or more of the nozzles of the nozzle plate. Typically, the spitting operation occurs at a location in the maintenance station. Over a period of time, the solids in the waste ink accumulate in the maintenance station, and the resulting waste ink build-up can affect the operation of the maintenance assembly.

Various attempts have been made to handle and transfer waste ink in an ink jet system. One such attempt is directed to an apparatus having a pump mechanism for carrying waste ink from the pump to a carrying member. Waste ink is supplied to the pump by a series of ink-absorbing materials which, by capillary action, transfer the waste ink to the pump. During operation, a print head wiper slides in contact with a wipe-over portion of an ink-absorbing member carried by an ink-absorbing spring at a predetermined position on the chassis, whereby ink, water droplets, and contaminants adhering to the wiper are imparted to the ink-absorbing member. The ink or water droplets adhering to the ink-absorbing members transfer from one member to another by capillary action, and ultimately to the pump mechanism for carrying waste ink from the pump to a waste ink carrying member.

Early ink jet printers used dye-based inks, which were mostly volatile liquids, and the maintenance operations required little capacity for waste ink generated from the spitting operation due to evaporation of the volatile liquid component of the ink and the relatively small quantity of solids in the ink. More recent products, however, have incorporated pigment-based inks that have a larger percentage of solids in them. After the volatile components evaporate, a sludge of mostly solid material is left behind. This solid material builds up in or below the maintenance assembly, and over time, storage capacity must be provided for the solid buildup in order for the maintenance station of the printer to operate properly. To address this increase in capacity, one method would be to increase the size of the waste ink collection reservoir for collecting the waste ink. Such an increase in capacity for collecting waste ink, however, would result in increased size of the printer and/or increased cost relating to the increased capacity for the waste ink collection reservoir.

Accordingly, a need exists for a printing system which includes a maintenance station which has the ability to effectively increase the amount of waste ink which can be collected without physically increasing the size of the waste ink collection reservoir.

SUMMARY OF THE INVENTION

The present invention is directed to apparatus and method for effectively increasing the waste ink capacity of an ink printing device, such as an ink jet printer, without the necessity of increasing the size of the waste ink collection reservoir of the ink printing device. The apparatus includes a spreader mechanism coupled to a drive mechanism of the ink printing device, wherein the spreader mechanism is driven by the drive mechanism to engage and disperse waste ink over a waste ink accumulation region.

In one embodiment of the invention, a maintenance unit is disclosed for use in an ink jet printer, wherein the ink jet printer includes a printer frame having a waste ink accumulation region. The maintenance unit includes a maintenance frame coupled to the printer frame, a maintenance sled moveably coupled to the maintenance frame, and a spreader mechanism coupled to the maintenance sled. The spreader mechanism disperses waste ink over the waste ink accumulation region as the maintenance sled moves relative to the maintenance frame.

Preferably, the spreader mechanism includes an elongate portion and a drive pin extending from the elongate portion, and the maintenance sled includes an aperture for receiving the drive pin of the spreader mechanism. In addition, the printer frame includes a pivot pin and the spreader mechanism rotates about the pivot pin due to a movement of the maintenance sled relative to the maintenance frame to disperse waste ink over the waste ink accumulation region.

Other features and advantages of the invention may be determined from the drawings and the detailed description of the invention that follows. Corresponding reference characters indicate corresponding elements throughout the several figures.

DETAILED DESCRIPTION OF PREFERRED EMBODIMENTS

Figure 1:
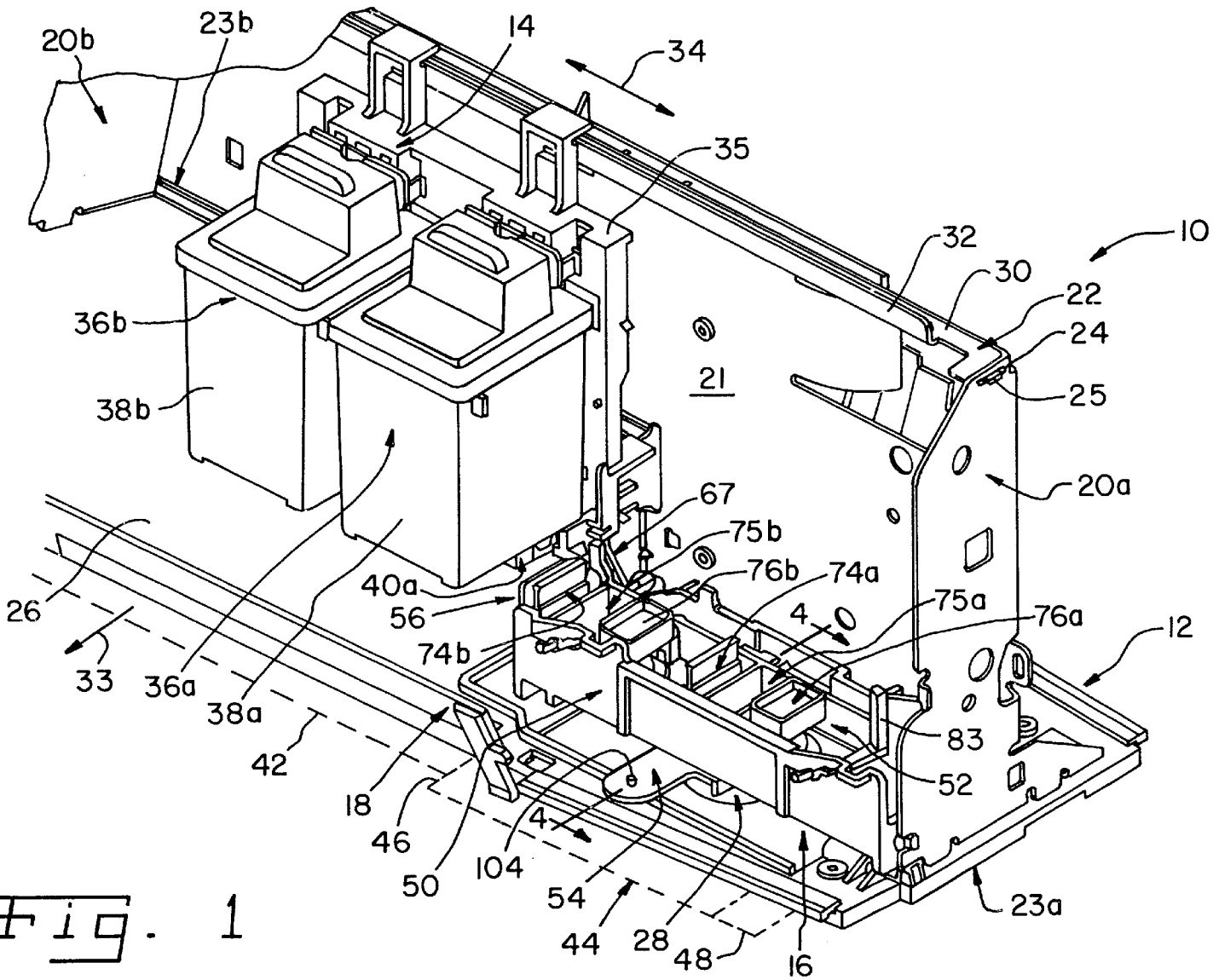
FIG. 1 is a partial, perspective view of the frame assembly of an ink jet printer including a maintenance assembly in accordance with the invention.

FIG. 1 shows a portion of an ink jet printer 10 which includes a printer frame 12, a printhead carrier assembly 14, and a maintenance assembly 16 in accordance with the present invention. Positional terms such as left, right, top, bottom, upper, lower, clockwise or counter-clockwise are assigned based on the orientation of printer 10 in FIG. 1 and should not be considered limiting terminology.

Printer frame 12 includes a bottom frame member 18, two side frame members 20*a*, 20*b*, a rear frame member 21, and a top frame member 22. Side frame members 20*a*, 20*b* are attached to, and extend generally vertically upwardly from, opposing ends 23*a*, 23*b* of bottom frame member 18. An upper portion of each of the side frame members 20*a*, 20*b* includes a slot 24 which is adapted to accept a tab 25 of top frame member 22 to mount and position top frame member 22 generally parallel to bottom frame member 18. Rear frame member 21 is disposed between side frame members 20*a*, 20*b*, generally above bottom frame member 18 and below top frame member 22. An upper surface 26 of bottom frame member 18 includes a waste ink accumulation region 28.

Top frame member 22 includes a horizontally extending guide portion 30 and a vertically upwardly extending guide rail 32 disposed at the rear side of guide portion 30. Guide rail 32 is adapted to slideably receive printhead carrier assembly 14 and permit reciprocating movement of printhead carrier assembly 14 in relation to guide rail 32 in the directions depicted by arrows 34.

Printhead carrier assembly 14 includes a carriage 35 which holds two print cartridges 36*a*, 36*b*, wherein print cartridge 36*a* contains a magenta, yellow and cyan colored pigment based inks and print cartridge 36*b* contains a black dye based ink. In general, pigment based inks contain more solid components than dye based inks.

Each of print cartridges 36*a*, 36*b* includes an ink reservoir 38*a*, 38*b* and a printhead 40*a*, 40*b*, respectively. Each of printheads 40*a*, 40*b* includes a nozzle plate (not shown) containing a plurality of nozzle openings (not shown) for selectively ejecting ink from the corresponding ink reservoirs 38*a*, 38*b*. Although ink reservoirs 38*a*, 38*b* and printheads 40*a*, 40*b*, respectively, are shown as forming an integral unit, i.e., print cartridges 36*a*, 36*b*, those skilled in the art will recognize that the reservoir may be mounted remotely from the printhead and connected to the printhead via a conduit. In such a configuration, printhead carrier assembly 14 would not need to carry the ink reservoir.

The reciprocating movement of printhead carrier assembly 14 along guide rail 32 is effected by a drive means (not shown) of a type known in the art, such as a belt coupled to a stepper motor. The movement of printhead carrier assembly 14 and the ejection of ink by print cartridges 36*a*, 36*b* are controlled by a microprocessor control means, types of which are known in the art. During operation, printhead carrier assembly 14 is moved by the drive means to position printheads 40*a*, 40*b* at various locations within the predetermined limits of permitted travel of printhead carrier assembly 14. Included in the limited travel of printhead carrier assembly 14 is a printing zone 42, and a maintenance zone 44 defined by a maintenance start position 46 and a capping region 48.

Printing operations occur in a conventional manner that is well understood in the art. A sheet of print media, such as paper, is carried under printheads 40*a*, 40*b*, but above bottom frame member 18. The sheet is carried by a series of rollers (not shown) in the direction shown by arrow 33. The sheet typically has a constant separation from printheads 40*a*, 40*b*. As the sheet is being carried, printheads 40*a*, 40*b* reciprocally traverse printing zone 42. Under the control and at locations selected by a microprocessor control means, print cartridges 36*a*, 36*b* selectively eject ink from the respective nozzles of printheads 40*a*, 40*b* onto the sheet.

During a maintenance operation, printheads 40*a*, 40*b* are moved into maintenance zone 44 to have a maintenance cycle performed. Two types of maintenance cycles are possible: a printing maintenance cycle and a printhead storage maintenance cycle. Both types of maintenance cycles, i.e., the printing maintenance cycle and the printhead storage maintenance cycle, are effected by maintenance assembly 16.

Maintenance assembly 16 is attached to printer frame 12 above waste ink accumulation region 28 of bottom frame member 18. Maintenance assembly 16 includes a maintenance frame 50, a maintenance sled 52 and a spreader mechanism 54. Preferably, maintenance assembly 16 is located such that a left end 56 of maintenance sled 52 generally defines maintenance start position 46 for printhead carrier assembly 14.

Figure 2:
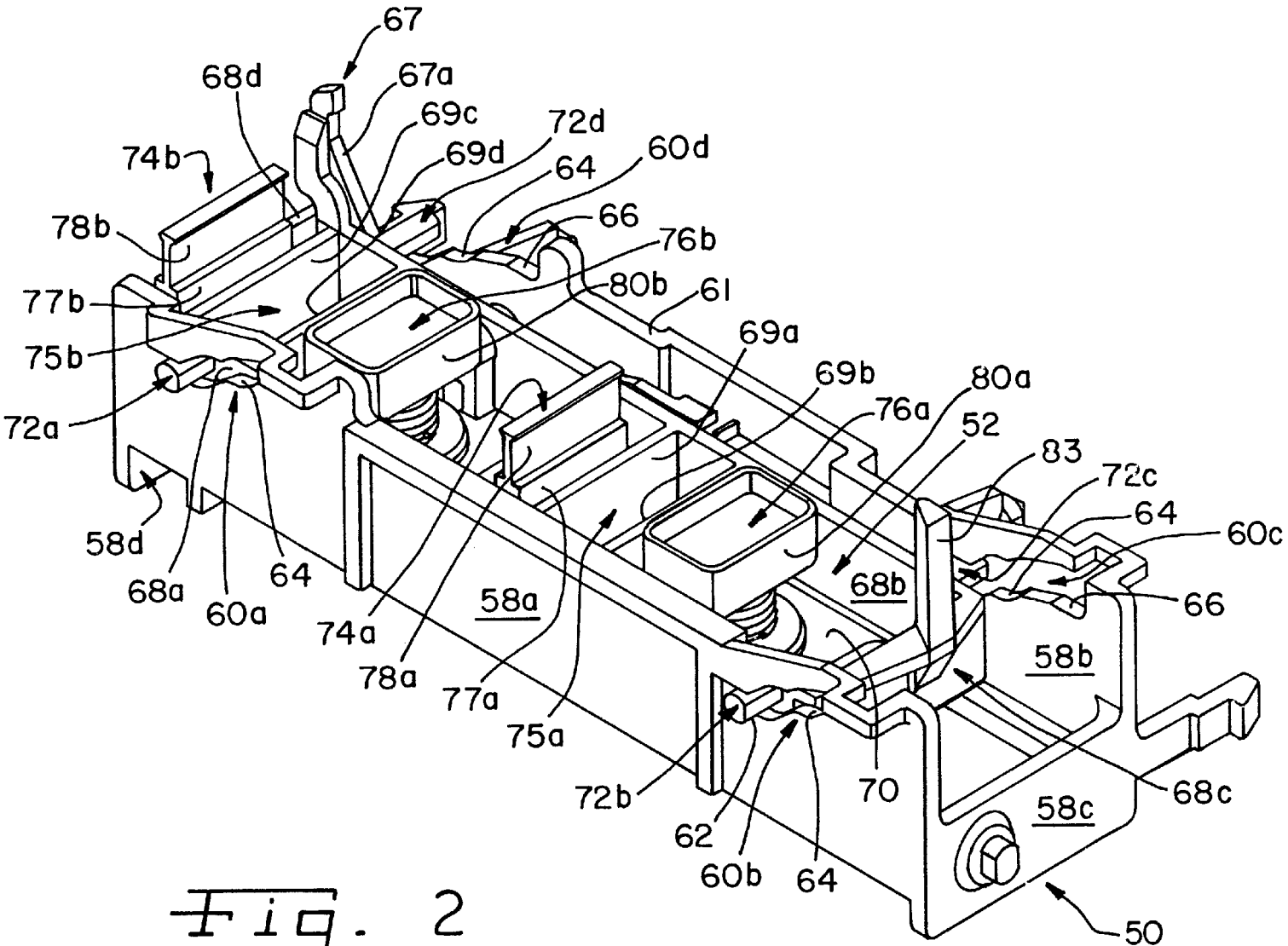
FIG. 2 is a detailed, perspective view of the maintenance assembly of FIG. 1.

Referring to FIGS. 1–2, maintenance frame 50 is a generally rectangular structure formed by vertical guide members 58*a*, 58*b*, 58*c*, and 58*d*. Vertical guide member 58*a* includes two ramped surfaces 60*a*, 60*b*, and vertical guide member 58*b* includes two ramped surfaces 60*c*, 60*d*. Ramped surfaces 60*a*, 60*b*, 60*c*, 60*d* provide vertical support for maintenance sled 52. Each of ramped surfaces 60*a*, 60*b*, 60*c*, 60*d* is upwardly inclined towards vertical member 58*c* and each contains three distinct elevations: a printing elevation 62; a wiping elevation 64; and capping elevation 66.

Maintenance frame 50 further includes a print latch 67 pivotally coupled at the intersection of vertical guide members 58*b*, 58*d*. Print latch 67 contains a stop surface 67*a* and a spring (not shown). Print latch 67 functions to actively control the placement of maintenance sled 52 along ramped surfaces 60*a*, 60*b*, 60*c*, 60*d*. When print latch 67 is in the open position, sled 52 is allowed to travel along ramped surfaces 60*a*, 60*b*, 60*c*, 60*d* to printing elevation 62. When print latch 67 is in the closed position, sled 52 is prohibited from traveling along ramped surfaces 60*a*, 60*b*, 60*c*, 60*d* to printing elevation 62. The spring biases print latch 67 towards the closed position. The structure and operation of print latch 67 is well known in the art.

Maintenance sled 52 is disposed within the open interior of maintenance frame 50, as shown in FIG. 2. Maintenance sled 52 has four generally vertical members 68*a*, 68*b*, 68*c* and 68*d* which form a rectangular structure. Maintenance sled 52 further includes a bottom horizontal member 70, and four dowel members 72*a*, 72*b*, 72*c* and 72*d*. Dowel members 72*a*, 72*b* extend horizontally, outward from vertical member 68*a* and dowel members 72*c*, 72*d* extend horizontally, outward from vertical member 68*b*. Dowel members 72*a*, 72*b*, 72*c*, 72*d* are supported by the corresponding ramped surfaces 60*a*, 60*b*, 60*c*, 60*d* on maintenance frame 50 and are guided along ramped surfaces 60*a*, 60*b*, 60*c*, 60*d* to raise or lower maintenance sled 52 relative to maintenance frame 50.

Maintenance sled 52 includes wiper assemblies 74*a*, 74*b*; discharge cavities 75*a*, 75*b*; and cap assemblies 76*a*, 76*b*. Each wiper assembly 74*a*, 74*b* contains a support structure 77*a*, 77*b* fixably attached to bottom member 70 of maintenance sled 52 and a wiper 78*a*, 78*b* made of an elastomeric material such as Texin 480-A (Miles, Inc.) secured to support structure 77*a*, 77*b*. Wiper assemblies 74*a*, 74*b* remove excess ink from the exterior of the nozzles on printheads 40*a*, 40*b*, respectively.

Discharge cavities 75*a*, 75*b*, are positioned to the right of wiper assemblies 74*a*, 74*b*, respectively. Discharge cavities 75*a*, 75*b* are defined by vertical members 68*a*, 68*b* and by cross-vertical members 69*a*, 69*b*, and 69*c*, 69*d*, respectively.

Cap assemblies 76*a*, 76*b* are positioned to the right of discharge cavities 75*a*, 75*b*. Cap assemblies 76*a*, 76*b* include printhead caps 80*a*, 80*b*.

Maintenance sled 52 further includes a capping tab 83 which extends vertically upward from vertical member 68*c*. Capping tab 83 facilitates the movement of sled 52 to wiping elevation 64 or to capping elevation 66 of ramped surfaces 60*a*, 60*b*, 60*c*, 60*d* when contacted by print cartridge 36*a*.

Figure 3:
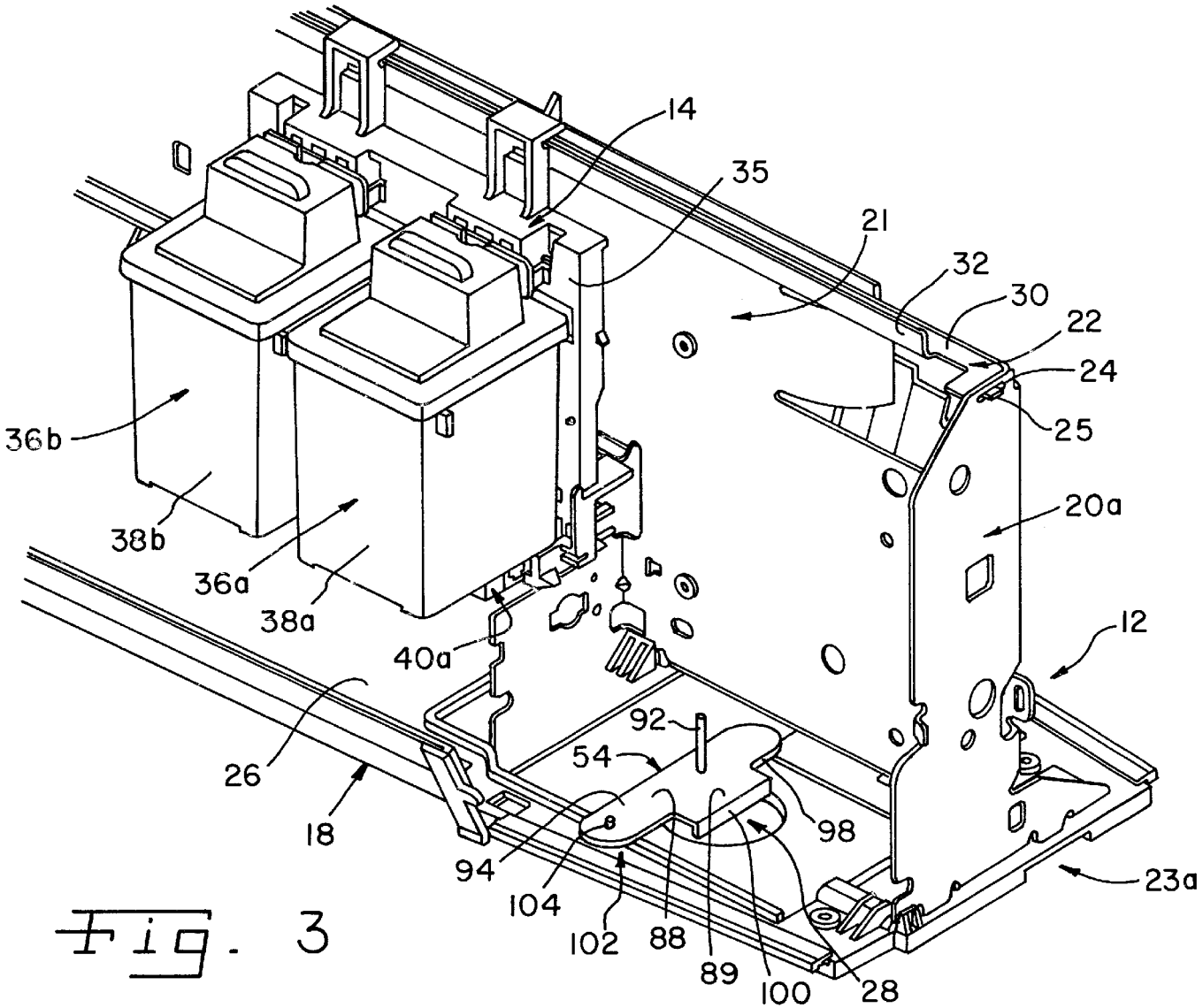
FIG. 3 is a partial, perspective view of the frame assembly of FIG. 1 with the maintenance frame and maintenance sled removed to expose the spreader mechanism.

FIG. 3 shows the arrangement of FIG. 1 with maintenance sled 52 and maintenance frame 50 removed to expose spreader mechanism 54, which is disposed directly above waste ink accumulation region 28 of bottom frame member 18 and directly below maintenance sled 52 (see FIG. 1).

Figure 4:
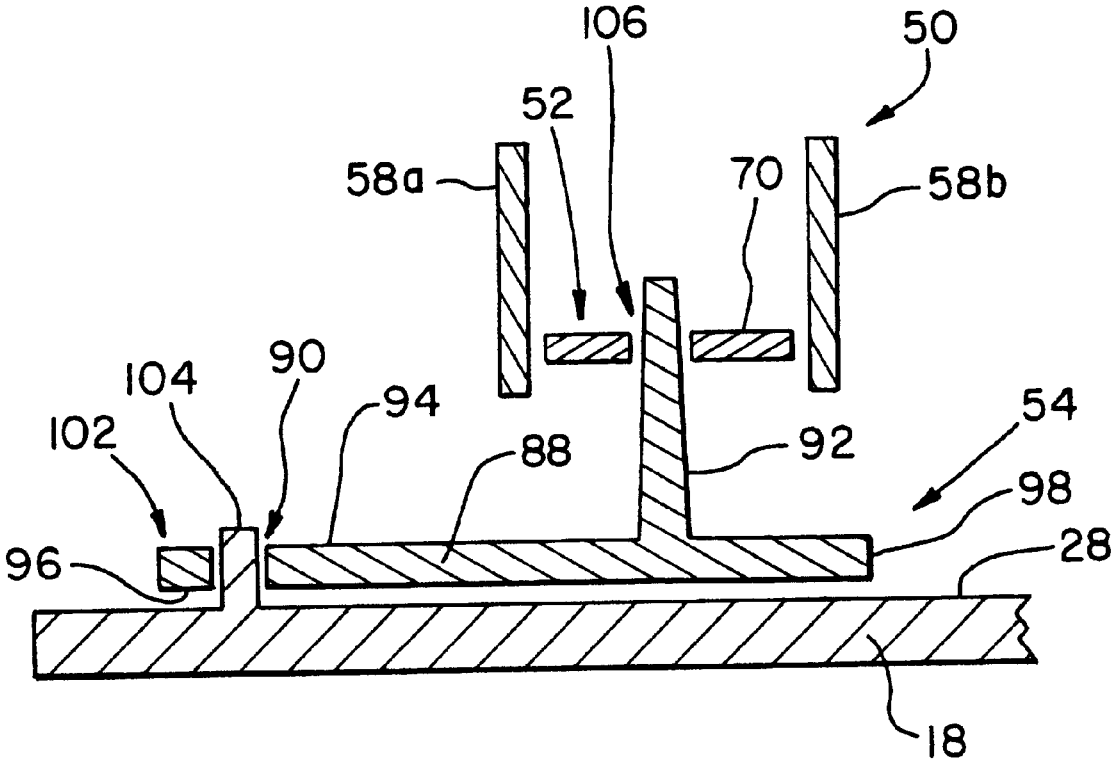
FIG. 4 is a partial, sectional view of the printer frame assembly and maintenance assembly of FIG. 1 along line 4—4 in FIG. 1.

Referring to FIGS. 3 and 4, spreader mechanism 54 includes a elongate portion 88, a blade portion 89, a vertical aperture 90, a drive pin 92, an upward-facing surface 94, a downward-facing surface 96, and a perimetrical surface 98. As shown in FIG. 3, blade portion 89 extends from and is coplanar with elongate portion 88, and defines a blade surface 100, which is formed from a portion of the perimetrical surface 98.

Vertical aperture 90 extends through a first end region 102 of elongate portion 88, and is sized to slideably receive a pivot pin 104 of bottom frame member 18. Pivot pin 104 and vertical aperture 90 cooperate to permit rotation of spreader mechanism 54 relative to bottom frame member 18 to spread ink residue accumulated in waste ink accumulation region 28. Pivot pin 104 can be made of plastic and heat staked to secure spreader mechanism 54 to bottom frame member 18.

Drive pin 92 facilitates the rotation of spreader mechanism 54 to coincide with the movement of sled 52. Drive pin 92 extends vertically upward from upward-facing surface 94 of elongate portion 88 and is received in a drive aperture 106 in maintenance sled 52, as shown in FIG. 4.

As maintenance sled 52 moves from left to right, spreader mechanism 54 rotates clockwise, thereby spreading the accumulated ink generally to the right of blade surface 100 of elongate portion 88 and blade portion 89. A right to left movement of maintenance sled 52 causes spreader mechanism 54 to rotate counter-clockwise to spread the accumulated ink generally to the left of elongate portion 88.

The operation of the spreader mechanism 54 will now be discussed in relation to the maintenance cycles, i.e., the printing maintenance cycle and printhead storage maintenance cycle, and will be discussed with reference to FIGS. 1–4.

In a printing maintenance cycle, printhead carrier assembly 14 moves to the right along guide rail 32 to maintenance region 44. Printhead carrier assembly 14 passes maintenance start position 46 and as printhead carrier assembly 14 moves farther to the right, the rightward leading print cartridge 36*a* contacts capping tab 83 of maintenance sled 52. This contact causes maintenance sled 52 to move to the right with the printhead carrier assembly 14. The rightward movement causes print latch 67 to momentarily reside in the open position thereby releasing sled 52 from printing elevation 62. The rightward movement raises maintenance sled 52 to wiping elevation 64 because dowel members 72*a*, 72*b*, 72*c*, 72*d* of maintenance sled 52 are guided along ramped surfaces 60*a*, 60*b*, 60*c*, 60*d*. In addition, the rightward movement of maintenance sled 52 causes spreader mechanism 54 to rotate clockwise about pivot pin 104 in conjunction with the generally lateral movement of maintenance sled 52. During the clockwise rotation of spreader mechanism 54, blade surface 100 engages and disperses, or spreads, the accumulated ejected ink and any solid components in waste ink accumulation region 28.

Once sled 52 reaches wiping elevation 64, print latch 67 resumes the closed position thereby impeding sled 52 from traveling back down ramped surfaces 60*a*, 60*b*, 60*c*, 60*d* to printing elevation 62 due to stop surface 67*a* on print latch 67. After print latch 67 resumes the closed position, printhead carrier assembly 14 begins to travel back to the left towards printing zone 42. As print cartridges 36*a*, 36*b* pass over discharge cavities 75*a*, 75*b*, respectively, ink is ejected from the nozzles in printheads 40*a*, 40*b*. The ejected ink falls through discharge cavities 75*a*, 75*b* and accumulates in waste ink accumulation region 28. As printhead carrier assembly 14 moves father to the left, the nozzles of printheads 40*a*, 40*b* are wiped by wipers 78*a*, 78*b* to remove excess ink from the nozzles and a portion of the leftward leading print cartridge 36*b* contacts print latch 67 causing print latch 67 to assume the open position. Once print latch 67 is in the open position, dowel members 72*a*, 72*b*, 72*c*, 72*d* of maintenance sled 52 migrate down ramped surfaces 60*a*, 60*b*, 60*c*, 60*d* from wiping elevation 64 to printing elevation 62 due to gravity. After printhead carrier assembly 14 has completely entered printing zone 42, print latch 67 resumes the closed position due to the spring bias of print latch 67.

During the leftward movement of maintenance sled 52, spreader mechanism 54 is caused to rotate counter-clockwise about pivot pin 104 in conjunction with the generally lateral movement of maintenance sled 52. During the counter-clockwise rotation of spreader mechanism 54, perimetrical surface 98 of spreader mechanism 54 further engages and disperses the accumulated ejected ink and any solid components in waste ink accumulation region 28.

The printhead storage maintenance cycle is generally analogous to the printing maintenance cycle, except that printhead carrier assembly 14 does not stop its rightward motion when maintenance sled 52 is at wiping elevation 64. Instead, printhead carrier assembly 14 continues to move to the right, thereby further moving maintenance sled 52 to the right until dowels 72*a*, 72*b*, 72*c*, 72*d* of sled 52 are at capping elevation 66 of ramp surfaces 60*a*, 60*b*, 60*c*, 60*d*. When maintenance sled 52 is at capping elevation 66 (defined as being in capping region 48), caps 80*a*, 80*b*, respectively form an air seal around the nozzles on printheads 40*a*, 40*b* to prevent the ink on the nozzles from drying. Printhead carrier assembly 14 can stay at capping region 48 for an indefinite amount of time.

The rightward movement of maintenance sled 52 causes spreader mechanism 54 to rotate clockwise about pivot pin 104 in conjunction with the generally lateral movement of maintenance sled 52. During the clockwise rotation of spreader mechanism 54, blade surface 100 engages and disperses the accumulated ejected ink and any solid components in waste ink accumulation region 28.

Once printhead carrier assembly 14 begins to move to the left toward printing zone 42, maintenance sled 52 migrates down ramp surfaces 60*a*, 60*b*, 60*c* 60*d* from capping elevation 66 to wiping elevation 64 thereby disengaging caps 80*a*, 80*b* from the respective printheads 40*a*, 40*b*. As stated earlier printheads 40*a*, 40*b* eject, or spit, ink from the nozzles through discharge cavities 75*a*, 75*b* and are wiped by wipers 78*a*, 78*b* as printhead carrier assembly 14 moves to the left. Maintenance sled 52 stays at wiping elevation 64 until the leftward leading print cartridge 36*b* on printhead carrier assembly 14 engages print latch 67.

During the leftward movement of maintenance sled 52, spreader mechanism 54 is caused to rotate counter-clockwise about pivot pin 104 in conjunction with the generally lateral movement of maintenance sled 52. During the counter-clockwise rotation of spreader mechanism 54, perimetrical surface 98 of spreader mechanism 54 further engages and disperses the accumulated ejected ink in waste ink accumulation region 28.

As shown in FIGS. 1–4 and described above, a single spreader mechanism 54 engages the ink ejected from print cartridge 36*a* and accumulated in waste ink accumulation region 28. However, one skilled in the art will recognize that the present invention can be adapted to accommodate ink jet printer systems having multiple pigment based ink cartridges. For example, and as described above, a single spreader mechanism can include both front and rear ink spreading surfaces. Where multiple pigment based ink cartridges are used, each ink spreading surface engages ink ejected through a different discharge cavity. Furthermore, a separate dedicated spreader mechanism can be provided for each print cartridge. It is also within the scope of the present invention to incorporate the spreader mechanism as an integral component of the maintenance sled.

By spreading the accumulated ink, and any solid components over a larger surface area of waste ink accumulation region 28, the waste ink storage capacity of printer 10 is increased without increasing the size of the printer or increasing the size of the waste ink reservoir. In addition, by preventing the accumulation of waste ink and any solid components at levels which would impede the operation of the maintenance sled, the life of the maintenance assembly, and in turn the life of the printer, is increased.

The exemplifications set forth herein illustrate preferred embodiments of the invention and should not be construed as limiting the scope of the invention. Although the invention has been described in detail with reference to certain preferred embodiments, those skilled in the art will recognize that variations and modifications exist within the scope and spirit of the present invention as described and defined in the following claims.

We claim:

1. An apparatus for increasing the waste ink storage capacity of an ink printing device, said ink printing device including a drive mechanism, said apparatus comprising a spreader mechanism coupled to said drive mechanism of said ink printing device, said drive mechanism driving said spreader mechanism in a rotary motion to engage and disperse waste ink over a waste ink accumulation region.

2. A maintenance unit for use in an ink jet printer, said ink jet printer including a printer frame having a waste ink accumulation region, said maintenance unit comprising:

a maintenance frame coupled to said printer frame;

a maintenance sled moveably coupled to said maintenance frame; and a spreader mechanism driveably coupled to said maintenance sled, wherein said spreader mechanism is rotated to disperse waste ink over said waste ink accumulation region as said maintenance sled moves relative to said maintenance frame.

3. A maintenance unit for use in an ink jet printer, said ink jet printer including a printer frame having a waste ink accumulation region, said maintenance unit comprising:

a maintenance frame coupled to said printer frame;

a maintenance sled moveably coupled to said maintenance frame; and a spreader mechanism driveably coupled to said maintenance sled, wherein said spreader mechanism disperses waste ink over said waste ink accumulation region as said maintenance sled moves relative to said maintenance frame, wherein said spreader mechanism comprises an elongate portion and a drive pin extending from said elongate portion, and wherein said maintenance sled includes a drive aperture for receiving said drive pin of said spreader mechanism.

4. A maintenance unit for use in an ink jet printer, said ink jet printer including a printer frame having a waste ink accumulation region, said maintenance unit comprising:

a maintenance frame coupled to said printer frame;

a maintenance sled moveably coupled to said maintenance frame; and a spreader mechanism driveably coupled to said maintenance sled, wherein said spreader mechanism disperses waste ink over said waste ink accumulation region as said maintenance sled moves relative to said maintenance frame, and wherein said spreader mechanism includes a perimetrical surface which engages said waste ink.

5. A maintenance unit for use in an ink jet printer, said ink jet printer including a printer frame having a waste ink accumulation region, said maintenance unit comprising:

a maintenance frame coupled to said printer frame;

a maintenance sled moveably coupled to said maintenance frame; and a spreader mechanism driveably coupled to said maintenance sled, wherein said spreader mechanism disperses waste ink over said waste ink accumulation region as said maintenance sled moves relative to said maintenance frame, and wherein said printer frame includes a pivot pin and said spreader mechanism includes a pivot aperture for receiving said pivot pin.

6. The maintenance unit as recited in claim 5, wherein said spreader mechanism rotates about said pivot pin due to a movement of said maintenance sled relative to said maintenance frame.

7. The maintenance unit as recited in claim 6, wherein said spreader mechanism further includes a perimetrical surface which engages said waste ink and disperses said waste ink.

8. A method for increasing the capacity of waste ink storage in an ink jet printer, said printer having at least one moveable printhead containing a nozzle capable of ejecting ink, the method comprising the steps of:

ejecting ink out of said nozzle of said at least one printhead; and spreading the ejected ink over a waste ink accumulation region based on a movement of said printhead.

9. An ink jet printer including a printhead having nozzles for ejecting ink, said ink jet printer comprising:

a printer frame having a waste ink accumulation region;

a printhead carrier assembly including a carriage for carrying said printhead, said printhead carrier assembly being mounted to said printer frame, said printhead carrier assembly effecting a reciprocating movement of said printhead through a printing zone during a printing operation and effecting movement of said printhead into a maintenance zone during a maintenance operation, said maintenance zone including a maintenance start position and a maintenance capping region; and a maintenance unit coupled to said printer frame above said waste ink accumulation region, said maintenance unit comprising:

a maintenance frame coupled to said printer frame;

a maintenance sled moveably coupled to said maintenance frame; and a spreader mechanism driveably coupled to said carriage via said maintenance sled, wherein said spreader mechanism disperses waste ink over said waste ink accumulation region as said carriage moves relative to said maintenance frame.

10. An ink jet printer including a printhead having nozzles for ejecting ink, said ink jet printer comprising:

a printer frame having a waste ink accumulation region;

a printhead carrier assembly including a carriage for carrying said printhead, said printhead carrier assembly being mounted to said printer frame, said printhead carrier assembly effecting a reciprocating movement of said printhead through a printing zone during a printing operation and effecting movement of said printhead into a maintenance zone during a maintenance operation, said maintenance zone including a maintenance start position and a maintenance capping region; and a maintenance unit coupled to said printer frame above said waste ink accumulation region, said maintenance unit comprising:

a maintenance frame coupled to said printer frame;

a maintenance sled moveably coupled to said maintenance frame; and a spreader mechanism driveably coupled to said maintenance sled, wherein said spreader mechanism disperses waste ink over said waste ink accumulation region as said maintenance sled moves relative to said maintenance frame, wherein said spreader mechanism comprises an elongate portion and a drive pin extending from said elongate portion, and wherein said maintenance sled includes a drive aperture for receiving said drive pin of said spreader mechanism.

11. An ink jet printer including a printhead having nozzles for ejecting ink, said ink jet printer comprising:

a printer frame having a waste ink accumulation region;

a printhead carrier assembly including a carriage for carrying said printhead, said printhead carrier assembly being mounted to said printer frame, said printhead carrier assembly effecting a reciprocating movement of said printhead through a printing zone during a printing operation and effecting movement of said printhead into a maintenance zone during a maintenance operation, said maintenance zone including a maintenance start position and a maintenance capping region; and a maintenance unit coupled to said printer frame above said waste ink accumulation region ,said maintenance unit comprising:

a maintenance frame coupled to said printer frame;

a maintenance sled moveably coupled to said maintenance frame; and a spreader mechanism driveably coupled to said maintenance sled, wherein said spreader mechanism disperses waste ink over said waste ink accumulation region as said maintenance sled moves relative to said maintenance frame, and wherein said printer frame includes a pivot pin and said spreader mechanism includes a pivot aperture for receiving said pivot pin.

12. The ink jet printer as recited in claim 11, wherein said maintenance sled includes a drive aperture for receiving a drive pin of said spreader mechanism such that said spreader mechanism rotates about said pivot pin due to the movement of said maintenance sled relative to said maintenance frame thereby causing said waste ink to be dispersed.

13. An ink jet printer including a printhead having nozzles for ejecting ink, said ink jet printer comprising:

a printer frame having a waste ink accumulation region;

a printhead carrier assembly including a carriage for carrying said printhead, said printhead carrier assembly being mounted to said printer frame, said printhead carrier assembly effecting a reciprocating movement of said printhead through a printing zone during a printing operation and effecting movement of said printhead into a maintenance zone during a maintenance operation, said maintenance zone including a maintenance start position and a maintenance capping region; and a maintenance unit coupled to said printer frame above said waste ink accumulation region, said maintenance unit comprising:

a maintenance frame coupled to said printer frame;

a maintenance sled moveably coupled to said maintenance frame; and a spreader mechanism driveably coupled to said maintenance sled, wherein said spreader mechanism disperses waste ink over said waste ink accumulation region as said maintenance sled moves relative to said maintenance frame, and wherein said printer frame includes a pivot pin and said spreader mechanism comprises:

an elongate portion having a pivot aperture for accepting a pivot pin on said printer frame; and a drive pin extending from said elongate portion.

14. The ink jet printer as recited in claim 13, wherein said spreader mechanism rotates about said pivot pin due to the movement of said maintenance sled relative to said maintenance frame thereby causing said waste ink to be dispersed.

* * * * *